US005331694A

United States Patent [19]

Mackenzie et al.

[11] Patent Number: 5,331,694

[45] Date of Patent: Jul. 26, 1994

[54] SAFETY SHOWER

[75] Inventors: Roderick J. Mackenzie, Penshurst; Ronald W. Slater, Seven Hills, both of Australia

[73] Assignee: Safetyman Pty Limited, Kingsgrove, Australia

[21] Appl. No.: 776,051

[22] Filed: Oct. 10, 1991

[30] Foreign Application Priority Data

Oct. 10, 1990 [AU] Australia ..... PK2752

[51] Int. Cl.[5] ..... B61H 33/00

[52] U.S. Cl. ..... 4/620; 138/103; 239/128

[58] Field of Search ..... 4/615, 620; 138/103, 138/148; 239/128, 547

[56] References Cited

U.S. PATENT DOCUMENTS 3,962,733 6/1976 Parry ..... 4/615
4,182,580 1/1980 Hioda et al. ..... 138/103 X
4,756,339 7/1988 Buluschek ..... 138/103 X

FOREIGN PATENT DOCUMENTS

48090/79 6/1979 Australia .
2635606 2/1978 Fed. Rep. of Germany ..... 239/547

*Primary Examiner*—Charles E. Phillips
*Attorney, Agent, or Firm*—Townsend and Townsend Khourie and Crew

[57] ABSTRACT

Disclosed is a safety shower or liquid delivery system (1). A deluge head (2) is supported by a liquid supply line (3). Supply line (3) comprises an inner pipe section (4) around which is located a porous sleeve (5) so as to define a liquid jacket (7) around pipe (4). The system is typically employed as an emergency deluge system to douse a worker for example with water in a situation where the worker has been subjected to exposure to some infectious, poisonous, corrosive or otherwise harmful substance. The water delivered via the deluge head (2) to the worker will be maintained at a safe temperature level within inner pipe section (4) by the cooling effect of water within the liquid jacket (7).

4 Claims, 3 Drawing Sheets

SAFETY SHOWER

FIELD OF THE INVENTION

The following invention relates to safety showers and more particularly, though not exclusively, to an emergency deluge system to douse a worker for example with water in a situation where the worker has been subjected to exposure to some infectious, poisonous, corrosive or otherwise harmful substance.

It is prudent practice to have deluge equipment readily available at the work place. The equipment should be readily accessible and should include a shower and/or eye wash to provide an abundance of water to a distressed workman.

PRIOR ART

Prior art deluge systems comprised a shower rose or deluge held supported by means of a water delivery pipe. Often such delivery pipe is exposed to heat and/or radiation from the sun and thus the water contained within the pipe becomes very hot and thus upon the already distressed worker opening the water delivery valve, further distress is caused as a result of scorching by the hot water.

OBJECT THE INVENTION

It is the object of the present invention to overcome or substantially ameliorate the above disadvantages.

DISCLOSURE OF THE INVENTION

There is disclosed herein a liquid delivery system comprising:

- a liquid delivery means,
- a liquid supply line to supply liquid to the liquid delivery means by way of a valve,
- a porous percolating sleeve located around and spaced from the supply line so as to define a liquid jacket therearound, and
- means to allow liquid communication between the supply line and the liquid jacket, As a result of the percolating sleeve of the above system, evaporation of the liquid is possible so as to prevent excessive build-up of temperature within the supply line even in a situation here the system is located outdoors in direct sunlight.

Typically, the liquid supply line is a rigid tube of stainless steel for example.

Advantageously, the percolating sleeve is formed of a porous flexible material such as commonly employed in fire hoses.

Generally, the liquid supply line is arranged vertically so as to support the liquid delivery means.

Advantageously, an eye wash basin is located at a position intermediate upper and lover ends of the liquid supply line.

BRIEF DESCRIPTION OF THE DRAWINGS

Preferred forms of the present invention will now be described by way of example with reference to the accompanying drawings, wherein.

DETAILED DESCRIPTION OF THE PREFERRED EMBODIMENTS

Figures 1, 2:
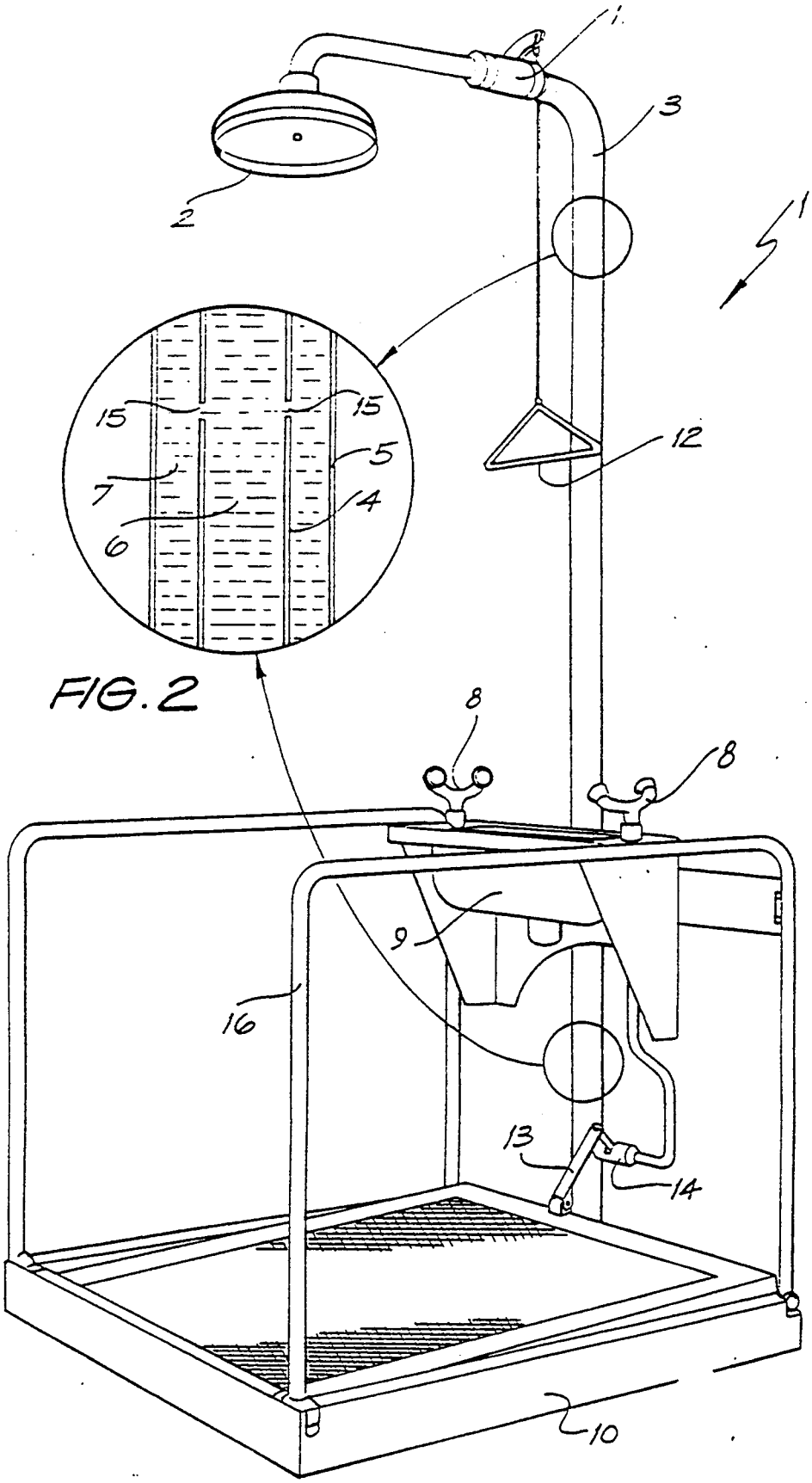
FIG. 1 is a schematic perspective view of a liquid delivery system in accordance with a first embodiment of the invention.
FIG. 2 is a schematic elevational sectional view of a portion of liquid supply line depicted as part of the system of FIG. 1.

In FIGS. 1 and 2 of the accompanying drawings there is schematically depicted a liquid delivery system 1 in accordance with a first embodiment of the invention. System 1 comprises a stainless steel deluge head or liquid delivery means 2 supported by a liquid supply line 3.

Liquid supply line 3 comprises an inner pipe section 4 around which is located a porous sleeve 5 so as to define a liquid jacket 7 around pipe 4. FIG. 2 depicts liquid also within pipe 4.

Located adjacent to the liquid delivery means 2 is a valve 11 which is actuated by way of handle 12.

The liquid supply line 3 is supported above a platform 10. At one edge of platform 10 is provided a pedal 13 which is adapted to actuate valve 14 to supply liquid to eye wash nozzles 8 located above the basin 9.

Hand rails 16 are also provided as a means for support for a user.

FIG. 2 depicts a cross-sectional view of the liquid delivery pipe 3. The rigid stainless steel tube 4 has provided in its wall at least one hole 15. Hole 15 serves to allow liquid communication between the pipe and the liquid jacket around the pipe and within the porous outer percolating sleeve 5. With valve 11 closed, the liquid supply pressure causes liquid to pass through holes 15 so as to inflate or partially inflate the percolating sleeve 5. As sleeve 5 is porous, the water within the liquid jacket region is allowed to permeate therethrough and then to evaporate so as to establish a cooling effect wherein the water within tube 4 is not allowed to reach excessive temperature levels.

Figure 3:
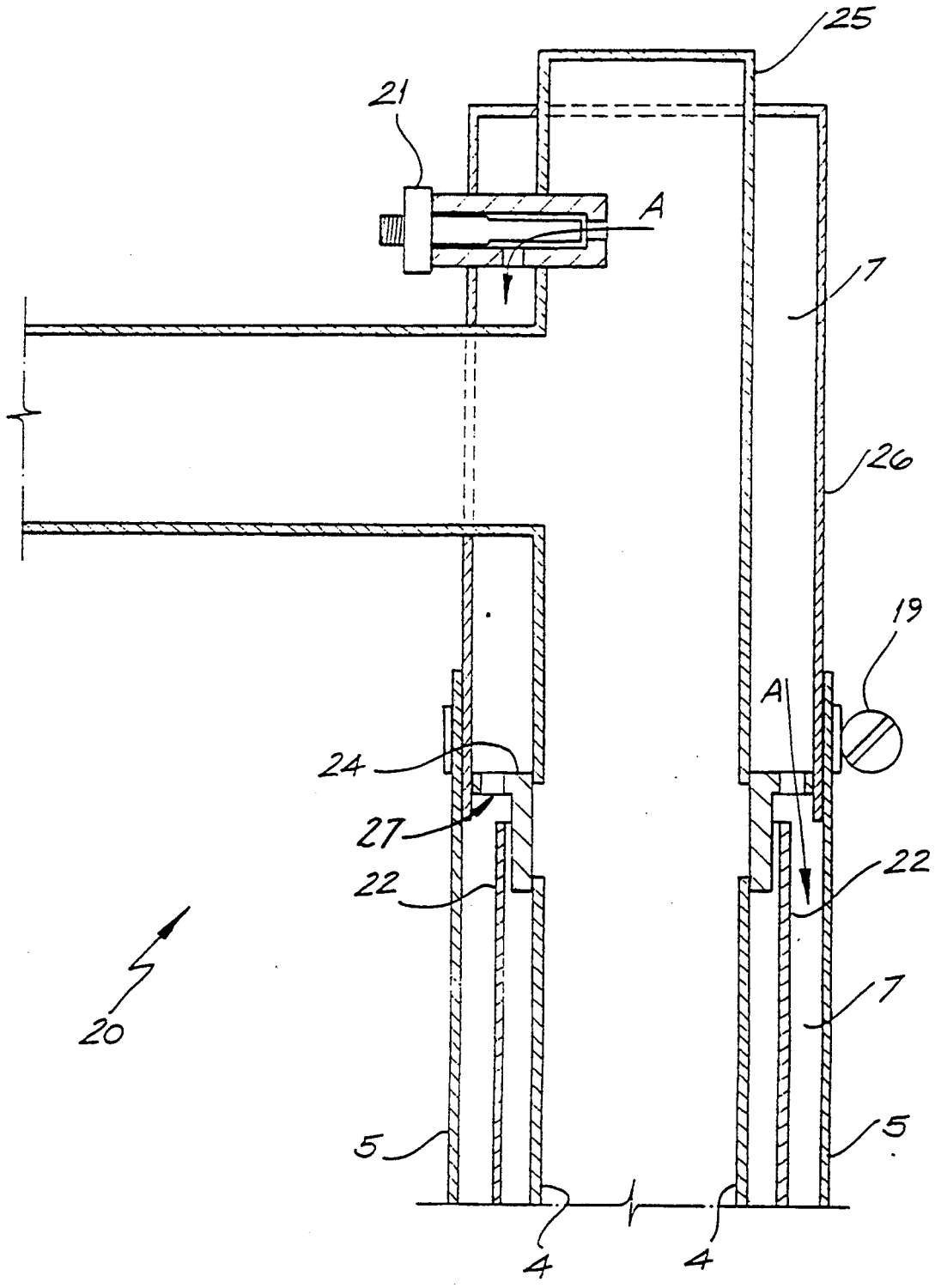
FIG. 3 is a schematic cross-sectional elevational view of a supply line head forming part of the structure depicted in FIG. 2.

A second embodiment of the invention depicted in FIG. 3 employs an alternative means of allowing the passage of water from supply line 3 to the liquid jacket 7. More particularly, a supply line head 20 as best depicted in FIG. 3 is provided. Head 20 provides a needle valve 21 for example which may be opened to allow the passage of liquid as indicated by arrows A.

Supply line head 20 comprises an inner cylinder 25 located co-axially within an outer cylinder 26 by way of a collar 24. Collar 24 comprises a number of longitudinal holes 27 to allow the passage of water downwardly therethrough into liquid jacket 7. Also depicted is an internal jacket support 22 which merely keeps the jacket in shape when it is subjected to water pressure. Internal jacket support 22 is a perforated rigid support which has cosmetic value only.

A number of clips 19 are depicted which retain porous sleeve 5 in position about supply line 3. The embodiment further comprises a handle located nearby nozzles 8 to activate ball valve 14 as an alternative to peddle 13. This embodiment also includes a water inlet.

Figure 4:
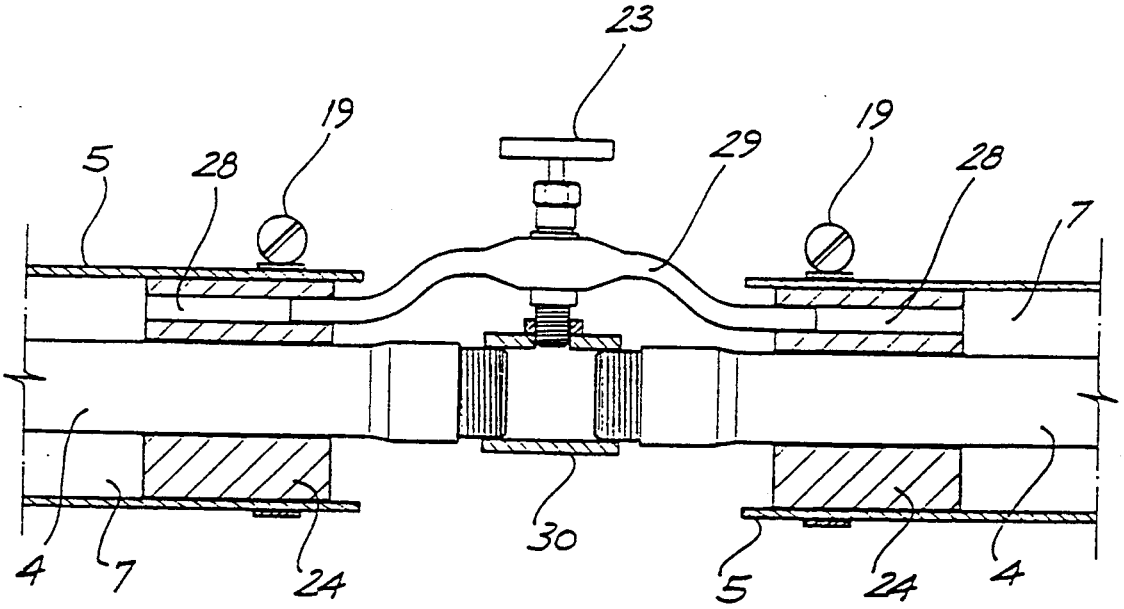
FIG. 4 is a schematic cross-sectional elevational view of a reticulating pipe line embodying principles of the invention depicted in FIGS. 1 to 3.

Turning now to FIG. 4 the cooling principles of the porous sleeve may also be embodied in a standard pipe line. Depicted is an inner pipe section 4 surrounded by a porous sleeve 5. Porous sleeve 5 is retained by clips 19 about a collar 24 having a longitudinal hole 28 extending therethrough. In communication with hole 28 is a tube section 29 having positioned in a mid region thereof a needle valve 23. Needle valve 23 accepts water via coupling 30 from inner pipe section 4 and delivers the water via holes 28 to liquid jacket 7.

In use of the first or second embodiments of the invention, a user having been subjected or exposed to some toxic chemical for example will step onto platform 10, pull handle 12 so as to actuate valve 11 whereby water is delivered by way of delivery means 2 to the user.

Pedal 13 or the handle described above may be activated by foot so as to cause water to disperse from eye nozzles 8 so that the user may rinse his/her eyes of chemicals therein.

It should be appreciated that modifications and alterations obvious to those skilled tn the art are not to be considered as beyond the scope of the present invention. For example, valve 11 and 14 may be replaced by a single valve to supply water to both delivery means 2 and eye nozzles 8.

What we claim is:

1. A safety shower comprising:

a liquid delivery means, a rigid liquid supply line to supply liquid to the liquid delivery means by way of a valve, a flexible porous evaporation sleeve located around and spaced from the supply line so as to define a liquid jacket therearound, and liquid flow means located in the supply line to allow passage of liquid between the supply line and the liquid jacket;

wherein evaporation of liquid will occur through the flexible porous sleeve, at least when liquid is at rest in the supply line, which will serve to cool the liquid in the supply line to prevent liquid of excessive temperature from reaching the liquid delivery means.

2. The safety shower of claim 1, wherein the means to allow liquid communication between the supply line and the liquid jacket comprises a supply line head having an inner cylinder in liquid communication with the supply line and a coaxially arranged outer cylinder in liquid communication with the liquid jacket and a valve to selectively allow liquid flow from the inner cylinder to the outer cylinder.

3. The safety shower of claim 1, wherein the means to allow liquid communication between the supply line and the liquid jacket comprises one or more apertures through the liquid supply line.

4. The safety shower of claim 1, further comprising an eye wash basin located at a position intermediate upper and lower ends of the liquid supply line.

* * * * *